US008170439B2

(12) United States Patent
Kim

(10) Patent No.: US 8,170,439 B2
(45) Date of Patent: May 1, 2012

(54) VOLTAGE SUPPLYING UNIT OF DEVELOPING DEVICE AND IMAGE FORMING APPARATUS HAVING THE SAME, AND A METHOD THEREOF

(75) Inventor: Min-seon Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/104,145

(22) Filed: May 10, 2011

(65) Prior Publication Data

US 2011/0211858 A1 Sep. 1, 2011

Related U.S. Application Data

(63) Continuation of application No. 11/756,834, filed on Jun. 1, 2007, now Pat. No. 7,962,059.

(30) Foreign Application Priority Data

Jul. 14, 2006 (KR) ..... 10-2006-66534

(51) Int. Cl.
*G03G 15/00* (2006.01)

(52) U.S. Cl. ..... 399/88; 399/90; 399/228; 399/229; 399/411

(58) Field of Classification Search ..... 399/88, 399/90, 228, 229, 411
See application file for complete search history.

(56) References Cited

U.S. PATENT DOCUMENTS

| | | | | |
|---|---|---|---|---|
| 5,627,722 | A * | 5/1997 | Hirst | 399/228 |
| 5,940,654 | A | 8/1999 | Uchiyama et al. | |
| 6,263,178 | B1 | 7/2001 | Takeyama et al. | |
| 7,167,687 | B2 | 1/2007 | Kemmochi et al. | |
| 7,266,321 | B2 | 9/2007 | Ahn et al. | |
| 7,962,059 | B2 * | 6/2011 | Kim | 399/228 |
| 2004/0067078 | A1 | 4/2004 | An et al. | |

FOREIGN PATENT DOCUMENTS

| | | |
|---|---|---|
| CN | 1497372 | 5/2004 |
| EP | 0716353 A1 | 6/1996 |
| JP | 5-197254 | 8/1993 |
| JP | 08-248768 | 9/1996 |
| JP | 2004-007408 | 1/2004 |
| JP | 2004-020408 | 1/2004 |
| JP | 2004-126584 | 4/2004 |
| KR | 2002-40106 | 7/2002 |
| KR | 2003-39845 | 6/2003 |

(Continued)

OTHER PUBLICATIONS

European Search Report dated Nov. 7, 2007 issued in EP 07109995.6.

(Continued)

*Primary Examiner* — Ryan Walsh
(74) *Attorney, Agent, or Firm* — Stanzione & Kim, LLP

(57) ABSTRACT

An image forming apparatus includes a plurality of developing devices, a voltage generating part to generate a developing voltage, first switching parts to supply the voltage generated in the voltage generating part to a predetermined developing device out of the plurality of developing devices, a second switching part to selectively supply the developing voltage generated in the voltage generating part to the first switching parts, and a controller to control the first switching parts and the second switching part.

14 Claims, 5 Drawing Sheets

FOREIGN PATENT DOCUMENTS

| | | |
|---|---|---|
| KR | 2004-5529 | 1/2004 |
| KR | 2004-32261 | 4/2004 |
| KR | 2004-53690 | 6/2004 |
| KR | 2004-103083 | 12/2004 |
| KR | 2006-64285 | 6/2006 |
| KR | 2004-110503 | 6/2007 |

OTHER PUBLICATIONS

Chinese Office Action issued Dec. 12, 2008 in CN Application No. 200710126846.X.

Japanese Office Action issued Dec. 6, 2011 in Japanese Application No. 2007-114777.

* cited by examiner

FIG. 5

| | 131Y YELLOW | 131M MAGENTA | 133C CYAN | 133K BLACK |
|---|---|---|---|---|
| SECOND SWITCHING(151) | X | X | Y | Y |
| FIRST SWITCHING(153a) | X | Y | X | X |
| FIRST SWITCHING(153b) | X | X | X | Y |

VOLTAGE SUPPLYING UNIT OF DEVELOPING DEVICE AND IMAGE FORMING APPARATUS HAVING THE SAME, AND A METHOD THEREOF

CROSS-REFERENCE TO RELATED APPLICATIONS

This application is a continuation application of Ser. No. 11/756,834 filed Jun. 1, 2007 now U.S. Pat. No. 7,962,059 in the U.S. Patent and Trademark Office, which claims the benefit of Korean Patent Application No. 10-2006-0066534, filed on Jul. 14, 2006, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to a voltage supplying unit of a developing device and image forming apparatus having the same, and a method thereof.

2. Description of the Related Art

A conventional image forming apparatus scans a laser onto a charged photosensitive body by a constant electric potential to form an electric latent image, spreads a predetermined color developer on the electrostatic latent image, and transfers and fixes the developer on a printing paper to form a color image. The color of the developer used in the color image forming apparatus typically comprises yellow (Y), magenta (M), cyan (C) and black (K).

The methods for forming a color image are classified into a single-pass type having four respective laser scanning units for four photosensitive bodies, and a multi-pass type having a laser scanning unit and a photosensitive body.

FIG. 1 is a schematic view illustrating a configuration of a conventional multi-pass type color image forming apparatus 1. As illustrated in FIG. 1, a color image forming apparatus 1 comprises a paper feeding part 10 in which printing papers are stored, a laser scanning unit 20 forming an electrostatic latent image on a photosensitive body 30, a four-color developing device 40 respectively spreading four colors of yellow 40*y*, magenta 40*m*, cyan 40*c*, and black 40*k* on the electrostatic latent image of the surface of the photosensitive body 30, a mid-transfer belt 50, including mid-transfer belt rollers 51 and 53, to which developer spread on the photosensitive body 30 is transferred, a transfer roller 60 transferring the developer of the mid-transfer belt 50 to a printing paper, a fixing part 70, including fixing part rollers 71 and 73, for fixing the developer on the printing paper, and a discharging part 80 for discharging the printed paper on which an image is formed to the outside.

The conventional image forming apparatus 1 with this configuration respectively applies a high voltage to the developing devices 40*k*, 40*y*, 40*m*, and 40*c* to adhere the respective color developer to the electrostatic latent image of the surface of the photosensitive body 30. As illustrated in FIG. 2, the color image forming apparatus 1 comprises a voltage generating part 90 for generating a high voltage, and a voltage switching part 98 for selectively applying the high voltage generated in the voltage generating part 90 to the respective color developing devices 40*k*, 40*y*, 40*m*, and 40*c*.

The conventional voltage switching part 98 comprises four switches 91, 93, 95, and 97 transferring the voltage generated in the voltage generating part 90 to the respective color developing devices 40*k*, 40*y*, 40*m*, and 40*c*. The four switches 91, 93, 95, and 97 determine through an on or off signal to supply voltage to the respective developing devices 40*k*, 40*y*, 40*m*, and 40*c* according to a color information included in the image data which will be output. For example, to form an image of only magenta color, only the switch 93 connected with the magenta developing device is turned on, and the other switches 91, 95, and 97 are turned off.

The conventional voltage switching part 98 with this configuration needs as many number of switches 91, 93, 95, and 97 as the developing devices 40*k*, 40*y*, 40*m*, and 40*c* to supply the voltage generated in the voltage generating part 90 to the respective color developing devices 40*k*, 40*y*, 40*m*, and 40*c*. Accordingly, as the number of the developing devices 40*k*, 40*y*, 40*m*, and 40*c* is increased, the number of the switches 91, 93, 95, and 97 needs to be increased, thereby causing manufacturing costs to rise.

SUMMARY OF THE INVENTION

The present general inventive concept provides a reliable voltage supplying unit which can supply voltage using a small number of switches even with the increased number of the developing devices and image forming apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing an image forming apparatus, comprising a plurality of developing devices, a voltage generating part to generate a developing voltage, first switching parts to supply the voltage generated in the voltage generating part to a predetermined developing device out of the plurality of developing devices, a second switching part to selectively supply the developing voltage generated in the voltage generating part to the first switching parts, and a controller to control the first switching parts and the second switching part.

The first switching parts may be provided in plurality.

The second switching part may comprise an input terminal to receive a control signal of the controller, and an output terminal corresponding to one of the first switching parts.

The first switching parts may comprise an input terminal corresponding to the output terminal of the second switching part, and an output terminal corresponding to one of the plurality of the developing devices.

The first switching parts may be provided as one of a relay type, a solenoid type, and a magnetic type.

The second switching part may be provided as one of a relay type, a solenoid type, and a magnetic type.

The first switching parts and the second switching part may be provided on a connecting circuit board disposed between the plurality of developing devices and the voltage generating part.

The foregoing and/or other aspects and utilities of the present general inventive concept may also be achieved by providing a developing device voltage supplying unit, including a plurality of developing devices, a voltage generating part to generate a developing voltage, first switching parts to supply the voltage generated in the voltage generating part to a predetermined developing device out of the plurality of developing devices, a second switching part to selectively supply the developing voltage generated in the voltage generating part to the first switching parts, and a controller to control the first switching parts and the second switching part.

The first switching parts may be provided in plurality.

The second switching part may comprise an input terminal to receive a control signal of the controller, and an output terminal corresponding one of the first switching parts.

The first switching parts may comprise an input terminal corresponding to the output terminal of the second switching part, and an output terminal corresponding to one of the plurality of developing devices.

The second switching part may be provided as one of a relay type, a solenoid type, and a magnetic type.

The first switching parts may be provided as one of a relay type, a solenoid type, and a magnetic type.

The first switching parts and the second switching part may be provided on a connecting circuit board disposed between the plurality of developing devices and the voltage generating part.

The foregoing and/or other aspects and utilities of the present general inventive concept may also be achieved by providing an image forming apparatus, including a plurality of developing device groups each comprising a plurality of developing devices, a voltage generating part to generate a developing voltage, and a voltage switching part to selectively supply the developing voltage to one of the plurality of developing device groups, wherein one of the developing devices in the selected developing device group is selected to receive the developing voltage to output a color corresponding to the developing device, and a number of the developing devices is greater than a number output terminals of the voltage switching part.

BRIEF DESCRIPTION OF THE DRAWINGS

The above and/or other aspects and utilities of the prevent general inventive concept will become apparent and more readily appreciated from the following description of the embodiments, taken in conjunction with the accompany drawings, of which:

FIG. 5 is a diagram illustrating a control signal according to respective color developing devices.

DETAILED DESCRIPTION OF THE PREFERRED EMBODIMENTS

Figure 1:
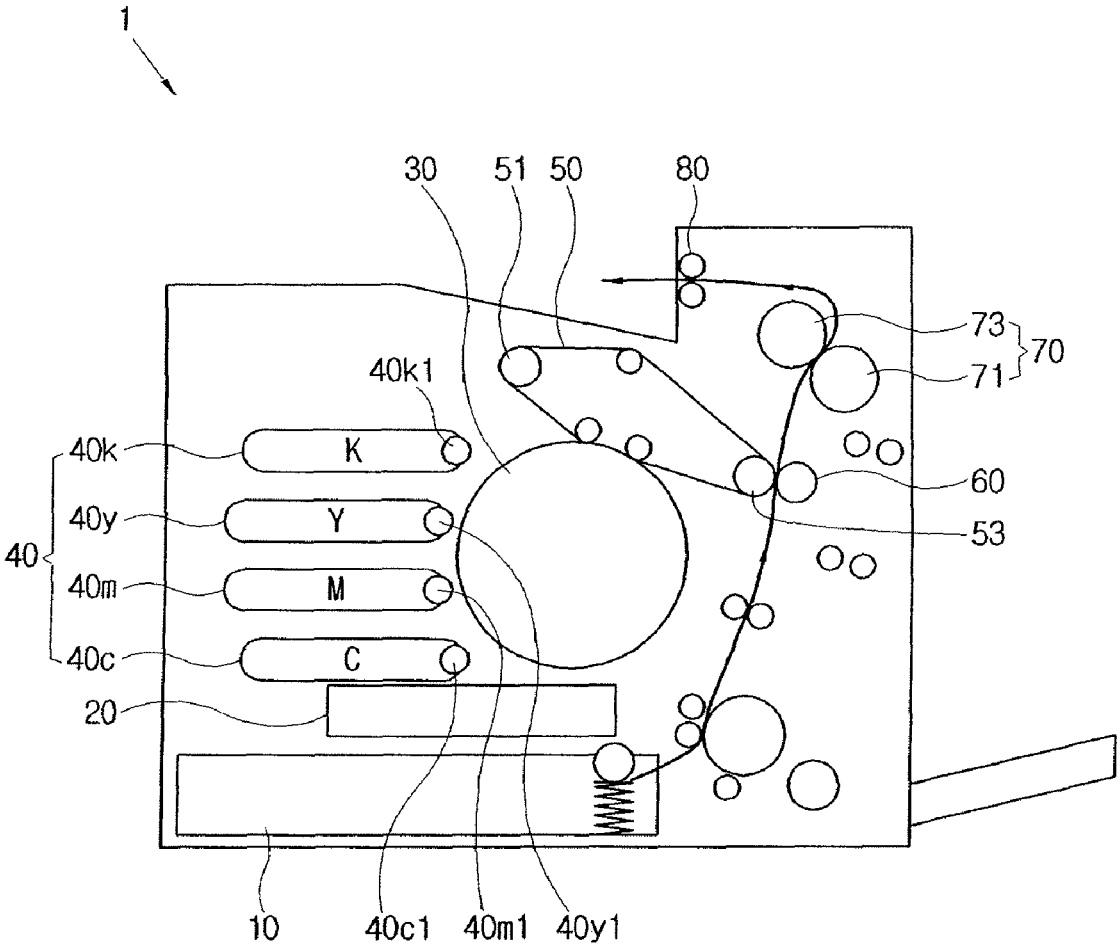
FIG. 1 (PRIOR ART)
FIG. 1 is a schematic view illustrating a configuration of a general image forming apparatus.
Figure 2:
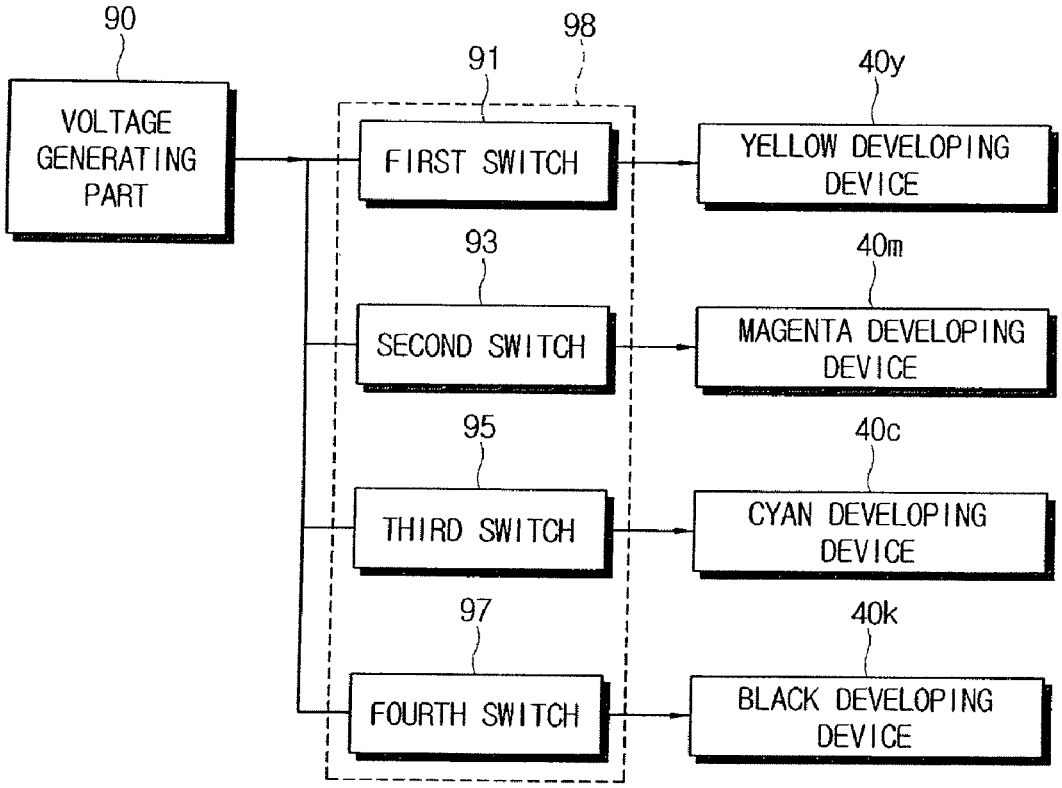
FIG. 2 (PRIOR ART)
FIG. 2 is a block diagram illustrating a voltage supplying unit of a conventional image forming apparatus.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 3:
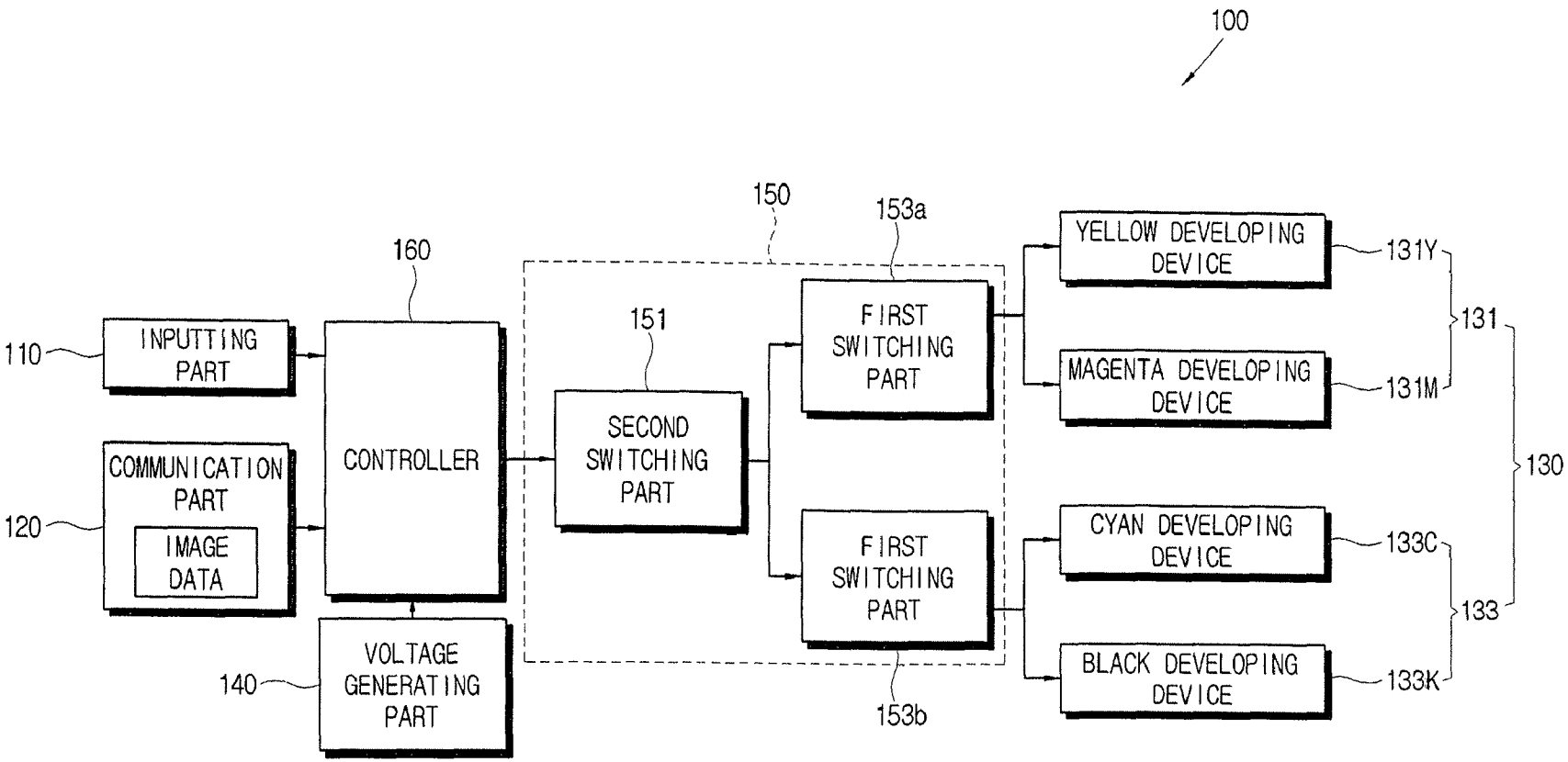
FIG. 3 is a block diagram schematically illustrating a configuration of an image forming apparatus according to an embodiment of the present general inventive concept.

As illustrated in FIG. 3, the image forming apparatus 100 according to the present general inventive concept comprises an inputting part 110 which is supplied with an output signal by a user, a communication part 120 to receive image data from a host (not illustrated), a developing device group 130 which comprises a plurality of developing devices 131Y, 131M, 133C, and 133K, a voltage generating part 140 to generate a developing voltage which the developing devices 131Y, 131M, 133C, and 133K need to perform developing, a voltage switching part 150 to supply the developing voltage generated in the voltage generating part 140 to the respective developing devices 131Y, 131M, 133C, and 133K, and a controller 160 to control the voltage switching part 150 to transfer the developing voltage generated in the voltage generating part 140 to a predetermined color developing device.

The inputting part 110 receives the output signal by the user. The inputting part 110 is typically provided in the shape of an inputting panel outside of the image forming apparatus 100 to be directly supplied with the output signal by the user, or may be provided through a user interface (UI) of the host (not illustrated).

The communication part 120 receives image data to be output from the host (not illustrated). The communication part 120 may be a connector which is directly connected through a host and a LAN-line or a USB, or may be a radio communication using a blue-tooth or an infrared ray communication.

The developing device group 130 comprises a plurality of developing device groups 131 and 133, in which a plurality of developing devices 131Y, 131M, 133C, and 133K are distributed. The developing device groups 131 and 133 may comprise a plurality of developing devices of different colors, or a plurality of developing devices of the same color. That is, the developing device group 130 may comprise a plurality of developing devices which have different colors out of the yellow developing device 131Y, the magenta developing device 131M, the cyan developing device 133C, and the black developing device 133K, or a plurality of developing devices which have the same color. Also, the developing device group 130 having the plurality of developing devices 131Y, 131M, 133C, and 133K may be provided in plural numbers.

As illustrated in FIG. 3, the developing device group 130 according to an embodiment of the present general inventive concept comprises a first developing device group 131 including a yellow developing device 131Y and a magenta developing device 131M, and a second developing device group 133 including a cyan developing device 133C and a black developing device 133K. However, the colors of the developing devices in the developing device groups 131 and 133 may be mutually exchanged.

Also, the developing device group 130 according to the present embodiment comprises a pair of developing devices having different colors, but may include three or four developing devices. That is, both first developing device group 131 and second developing group 133 may each include all four developing devices of yellow, magenta, cyan, and black.

Also, the developing device group 130, according to another embodiment of the present general inventive concept, may include three or more developing device groups 131 and 133 which include a plurality of developing devices.

Here, a number of the developing devices in the developing device groups 131 or 133 and a number of the respective developing device groups 131 and 133 may be properly provided in consideration of a capacity of the image forming apparatus 100, a size of a printing paper, and an outputting frequency of the respective color developing devices 131Y, 131M, 133C, and 133K. For example, when an image forming apparatus 100 includes a large outputting capacity, the developing device groups 131 comprising a plurality of developing devices having the same color may be provided with another color of the developing device group 133 comprising a plurality of developing devices having the same color. Also, sensors to sense an amount of remaining developer may be provided in the developing device groups 131 and 133 to supply power to different developing devices having the same color when that developer in a particular color developing device is used up. Also, if a particular color has a high output frequency (i.e., is output often), a plurality of developing devices having the same color may be provided separately as a developing device group. For example, if black is a color with a high output frequency, developing device group 131 may comprise plural developing devices 131K, each outputting black ink.

The respective developing devices 131Y, 131M, 133C, and 133K may comprise a developer storing part (not illustrated) in which developer is stored, developing rollers (not illustrated, but may be similar to developing rollers 40*k*1, 40*y*1, 40*m*1, and 40*c*1 illustrated in FIG. 1) to supply the developer to a photosensitive body 30, a supplying roller (not illustrated) to supply the developer of the developer storing part (not illustrated) to the developing rollers, and a developer regulating blade (not illustrated) to uniformly regulate an amount of the developer which is adhered to the developing rollers. The description of the configuration of the developing devices 131Y, 131M, 133C, and 133K will be omitted as it is equivalent to a conventional configuration similar to that illustrated in FIG. 1.

The voltage generating part 140 generates a developing voltage corresponding to the developing devices 131Y, 131M, 133C, and 133K to develop developer on the photosensitive body 30. The developing rollers of the developing devices 131Y, 131M, 133C, and 133K may be separated as much as a developing gap from the photosensitive body 30. To develop the developer on the photosensitive body 30, a jumping development method is used. A high voltage may be applied to the developing rollers to perform the jumping developing. The voltage generating part 110 generates a high developing voltage which the developing rollers may need to perform developing.

The developing voltage generated in the voltage generating part 140 may include a high voltage in which an alternating voltage and a direct voltage are superimposed. However, either a direct or an alternating high voltage may be generated as necessary. Also, the developing voltage generated in the voltage generating part 140 can be supplied separately with different voltages corresponding to the developing rollers inside the developing devices 131Y, 131M, 133C, and 133K, the developer regulating blade (not illustrated), and the supplying roller (not illustrated), or may be a reference voltage value. Accordingly, when the reference voltage is generated, a voltage converting part (not illustrated) to convert the reference voltage into respective voltage values corresponding to the developing rollers, the developer regulating blade (not illustrated), and the supplying roller (not illustrated) are included inside the developing devices 131Y, 131M, 133C, and 133K.

The voltage switching part 150 selectively supplies the developing voltage generated in the voltage generating part 140 to the respective developing devices 131Y, 131M, 133C, and 133K. The voltage switching part 150 may comprise a second switching part 151 to selectively supply the developing voltage generated in the voltage generating part 140 to one of the plurality of developing device groups 131 and 133, and first switching parts 153*a* and 153*b* (which may also be referred to collectively as a first switching part 153) to supply the developing voltage received through the second switching part 151 to one of the developing devices 131Y, 131M, 133C, and 133K inside the developing device groups 131 and 133.

The second switching part 151 selectively supplies the developing voltage generated in the voltage generating part 140 to one of the plurality of developing device groups 131 and 133. The second switching part 151 comprises one input terminal to receive a control signal from the controller 160, and a plurality of output terminals corresponding to the number of the respective developing device groups 131 and 133. Here, as illustrated in FIG. 3, the second switching part 151 according to an embodiment of the present general inventive concept switches the developing voltage to be selectively supplied to one of the two developing device groups 131 and 133. Conventional methods of applying voltage to one of a large number of output terminals may be used as switching methods of the second switching part 151.

The first switching part 153 switches the developing voltage supplied through the second switching part 151 to be transferred to a predetermined developing device. The first switching part 153 comprises one input terminal to receive a control signal from the controller 160, and a plurality of output terminals corresponding to the number of the respective developing devices 131Y, 131M, 133C, and 133K. The first switching part 153, according to the embodiment of the present general inventive concept, may include two first switching parts 153*a* and 153*b*, respectively, corresponding to the two developing device groups 131Y, 131M, and 133C, 133K. Conventional methods of applying voltage to one of a large number of output terminals may be used as switching methods of the first switching parts 153*a* and 153*b*.

The voltage switching part 150 may be provided on a connecting circuit board (not illustrated) disposed between the voltage generating part 140 and the developing device group 130 to decrease a number of wire harnesses which transfer the voltage from the voltage generating part 140 to the respective developing devices 131Y, 131M, 133C, and 133K. That is, the output terminal of the first switching parts 153*a* and 153*b* in the voltage switching part 150 may be directly connected to the input terminal of the developing devices 131Y, 131M, 133C, and 133K to decrease the use of the wire harnesses.

The output terminal of the first switching parts 153*a* and 153*b* may include a predetermined resistance to apply a predetermined bias voltage to the other developing devices except for a particular developing device in the case that voltage is supplied to the particular color developing devices 131Y, 131M, 133C, 133K according to the control signal of the controller 160. Accordingly, when the developer of the particular color developing device is developed on the photosensitive body 30, and the developer that is adhered to the photosensitive body 30 is transferred to the mid-transfer belt 50, contamination of the other color developer by the particular color developer which is not transferred to the mid-transfer belt 60, but remains on the surface of the photosensitive body 30, can be prevented.

The second switching part 151 and the first switching parts 153*a* and 153*b* may be provided as one of a relay type disclosed in Korean Patent Application No. 2003-0039845, a solenoid type disclosed in Korean Patent Application No. 2002-0040106, and a magnetic type disclosed in Korean Patent Application No. 2004-0103083.

The controller 160 controls the voltage switching part 150 to supply the developing voltage of the voltage generating part 140 to the developing devices 131Y, 131M, 133C, 133K corresponding to the color information of the image data according to an output signal of the inputting part 110. The controller 160 controls the second switching part 161 to supply the developing voltage to the developing device groups 131 and 133 that comprise a particular developing device corresponding to the color information of the image data, and controls the first switching parts 153*a* and 153*b* to transfer the developing voltage received through the second switching part 151 to the particular developing device. The controller 160 controls not only the first switching part 153*a* or 153*b* where the particular color developing device is connected, but also the first switching part 153*b* or 153*a* where the corresponding color developing device is not connected.

In the multi-pass type image forming apparatus 100 according to the present embodiment, the controller 160 controls the voltage switching part 150 to sequentially supply the developing voltage to the respective color developing devices 131Y, 131M, 133C, and 133K.

Figure 4:
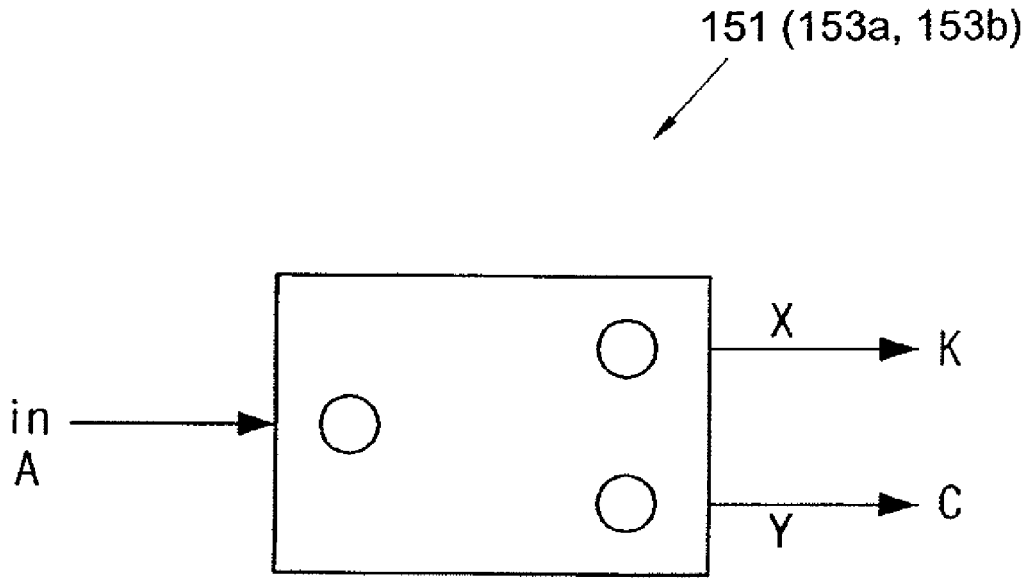
FIG. 4 is an exemplary view illustrating a configuration of switching parts according to an embodiment of the present general inventive concept.

An image forming process of the image forming apparatus 100 with this configuration according to the present general inventive concept will be described while referring to FIGS. 3, 4 and 5.

First, when an output signal is applied through the inputting part 110, the communication part 120 receives image data from a host (not illustrated). The controller 160 analyzes color information of the received image data. The laser scanning unit 20 of FIG. 1 sequentially forms an electrostatic latent image corresponding to the respective color developer on the photosensitive body 30 of FIG. 1 according to the analyzed result.

Accordingly, it is assumed that electrostatic latent images are formed on the photosensitive body 30 in the order of yellow, magenta, cyan, and black. As illustrated in FIG. 4, when the respective switching parts 151, 153*a* and 153*b* are switched to output a developing voltage A through output terminal 'X' out of two output terminals, the developing voltage A is transferred to an input terminal 'K' which is connected with the output terminal 'X.' When the respective switching parts 151, 153*a* and 153*b* are switched to output through a second output terminal 'Y', the voltage is transferred to an input terminal 'C' which is connected with the output terminal 'Y'.

As illustrated in FIG. 5, when developing the developer of the yellow developing device 131Y on the photosensitive body 30, the controller 160 controls the second switching part 151, the first switching part 153*a*, and the first switching part 153*b* to be respectively switched to the positions 'X', 'X' and 'X'. Accordingly, the developer of the yellow developing device 131Y may be adhered to the electrostatic latent image of the photosensitive body 30, and the yellow developer that is adhered to the photosensitive body 30 is transferred to the mid-transfer belt 50.

After the yellow developer is transferred to the mid-transfer belt 50, the laser scanning unit 20 forms a magenta electrostatic latent image on the photosensitive body 30. Also, the controller 160 controls the second switching part 151, the first switching part 153*a*, and the other first switching part 153*b* to switch to the positions 'X','Y' and 'X', respectively, to supply the voltage to the magenta developing device 131M.

The magenta developer that is adhered to the photosensitive body 30 is reiterated, that is, transferred to the mid-transfer belt 50 to which the yellow developer has been transferred.

After the yellow developing device 131Y and the magenta developing device 131M have performed developing, the cyan developing device 133C and the black developing device 133K may perform developing through the same process described above. Accordingly, the controller 160 respectively may control the second switching part 151, the first switching part 153*a*, and the first switching part 153*b* to be respectively switched to the positions 'Y', 'X' and 'X' to apply the voltage to the cyan developing device 133C.

Also, the controller 160 controls the second switching part 151, the first switching part 153*a*, and the other first switching part 153*b* to be switched to the positions 'Y', 'X' and 'Y', respectively, to supply voltage to the black developing device 133K.

Accordingly, the developing image of the mid-transfer belt 50 in which yellow developer, magenta developer, cyan developer, and black developer have been superimposed is finally transferred to a printing paper by a transfer voltage of the transfer roller 60, and the printing paper on which the image is formed is discharged to outside the image forming apparatus 100 via a fixing process.

As described above, an image forming apparatus 100 according to the present general inventive concept can group the respective developing devices 131Y, 131M, 133C, 133K into developing device groups 131 and 133 according to an intended use thereof and frequency of use. Also, the first switching parts 153*a* and 153*b* are provided to correspond to a number of the developing device groups 131 and 133, and a second switching part 151 is also provided to selectively apply the voltage to one of the first switching parts 153*a* and 153*b*.

When the voltage is applied to the developing devices 131Y, 131M, 133C and 133K, four switching parts are needed in a conventional image forming apparatus. In contrast, in the image forming apparatus according to an embodiment of the present general inventive concept only three switching parts are required to obtain the same effect as in the conventional image forming apparatus. Also, this may be more effective when the voltage is applied to five or more developing devices.

Since the same effect can be obtained through a small number of switching parts, a manufacturing unit cost can be lowered and the size of the connecting circuit board having switching parts can be reduced.

The above-described embodiment of the present general inventive concept is applied to a multi-pass typed color image forming apparatus, but the present general inventive concept may be applied to other types of image forming apparatus comprising a plurality of developing devices.

As described above, the image forming apparatus according to the present general inventive concept comprises a smaller number of switching parts which switch voltage to respective developing devices and can obtain the same effect as in the conventional image forming apparatus.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a plurality of developing devices;

a plurality of first switching parts to selectively supply a developing voltage to at least one developing device out of the plurality of developing devices;

a second switching part to selectively supply the developing voltage to the plurality of first switching parts; and a controller to control the plurality of first switching parts and the second switching part, wherein the first switching parts and the second switching part comprises a plurality of output terminals, respectively, and each of the first switching parts and the second switching part are switched to output the developing voltage through a predetermined output terminal out of the plurality of output terminals, the developing voltage is transferred to a developing device that is connected with the predetermined output terminal of the first switching parts.

2. The image forming apparatus according to claim 1, wherein the second switching part comprises an input terminal to receive a control signal of the controller, wherein the output terminals of the second switching part corresponds to each of the plurality of first switching parts.

3. The image forming apparatus according to claim 2, wherein each of the plurality of first switching parts comprises an input terminal corresponding to the output terminal of the second switching part, wherein the output terminals of the first switching parts corresponds to each of the plurality of the developing devices.

4. The image forming apparatus according to claim 3, wherein the second switching part is provided as one of a relay type, a solenoid type, and a magnetic type.

5. The image forming apparatus according to claim 2, wherein the plurality of first switching parts are provided as one of a relay type, a solenoid type, and a magnetic type.

6. The image forming apparatus according to claim 2, wherein the output terminal of the second switching part is commonly connected to each input of each first switching part among the plurality of first switching parts.

7. The image forming apparatus according to claim 1, further comprising a power supply to supply the developing voltage.

8. A method of controlling an image forming apparatus including a plurality of developing devices, the method comprising:

selectively supplying a developing voltage to a plurality of first switching parts by a second switching part; and selectively supplying the developing voltage to at least one developing device out of the plurality of developing devices by a plurality of first switching parts, wherein the first switching parts and the second switching part comprises a plurality of output terminals, respectively, and each of the first switching parts and the second switching part are switched to output the developing voltage through a predetermined output terminal out of the plurality of output terminals, the developing voltage is transferred to a developing device that is connected with the predetermined output terminal of the first switching parts.

9. The method according to claim 8, wherein the second switching part comprises an input terminal to receive a control signal of the controller, and wherein the output terminals of the second switching part corresponds to each of the plurality of first switching parts.

10. The method according to claim 9, wherein each of the plurality of first switching parts comprises an input terminal corresponding to the output terminal of the second switching part, and wherein the output terminals of the first switching parts corresponds to each of the plurality of the developing devices.

11. The method according to claim 10, wherein the second switching part is provided as one of a relay type, a solenoid type, and a magnetic type.

12. The method according to claim 9, wherein the plurality of first switching parts are provided as one of a relay type, a solenoid type, and a magnetic type.

13. The method according to claim 9, wherein the output terminal of the second switching part is commonly connected to each input of each first switching part among the plurality of first switching parts.

14. The method according to claim 8, further comprising generating the developing voltage by a power supply.

* * * * *